US008215659B2

(12) United States Patent
Binder

(10) Patent No.: US 8,215,659 B2
(45) Date of Patent: Jul. 10, 2012

(54) SKI

(75) Inventor: Oliver Binder, Wels (AT)

(73) Assignee: Kaestle GmbH, Wels (AT)

( * ) Notice: Subject to any disclaimer, the term of this patent is extended or adjusted under 35 U.S.C. 154(b) by 243 days.

(21) Appl. No.: 12/666,038

(22) PCT Filed: Jun. 24, 2008

(86) PCT No.: PCT/EP2008/005088

§ 371 (c)(1),
(2), (4) Date: Dec. 22, 2009

(87) PCT Pub. No.: WO2009/000496

PCT Pub. Date: Dec. 31, 2008

(65) Prior Publication Data

US 2010/0187795 A1 Jul. 29, 2010

(30) Foreign Application Priority Data

Jun. 28, 2007 (AT) ..... A 1005/2007

(51) Int. Cl.
*A63C 5/00* (2006.01)

(52) U.S. Cl. ..... 280/601

(58) Field of Classification Search ..... 280/601, 280/610

See application file for complete search history.

(56) References Cited

U.S. PATENT DOCUMENTS 5,032,139 A * 7/1991 Recher et al. ..... 8/471
5,158,034 A * 10/1992 Hsu ..... 114/315
6,431,733 B2 * 8/2002 Seifert et al. ..... 362/459
6,854,748 B2 * 2/2005 Wimbish et al. ..... 280/87.042
6,883,823 B2 * 4/2005 Riepler et al. ..... 280/602
7,232,243 B1 * 6/2007 Nassif ..... 362/459
7,404,564 B2 * 7/2008 Bregeon et al. ..... 280/14.21
7,445,218 B2 * 11/2008 Esposito et al. ..... 280/87.042
7,487,991 B2 * 2/2009 Degasperi et al. ..... 280/607
8,020,886 B2 * 9/2011 Kirby ..... 280/601
2003/0153221 A1 * 8/2003 Weir ..... 441/66

FOREIGN PATENT DOCUMENTS

| | | |
|---|---|---|
| AT | 339187 | 1/1977 |
| DE | 10148031 | 4/2003 |
| FR | 2616340 | 12/1998 |
| FR | 2818915 | 7/2002 |
| WO | WO-9515794 | 6/1995 |
| WO | WO-03008801 | 7/2000 |

* cited by examiner

*Primary Examiner* — J. Allen Shriver, II
*Assistant Examiner* — James M Dolak
(74) *Attorney, Agent, or Firm* — Andrew Wilford

(57) ABSTRACT

The invention relates to a ski having a ski blade, the ski being configured in layers, the ski blade having at least one material recess, and the ski comprising at least one strap made of a high-strength opaque material, particularly metal, such as aluminum, and at least one strap made of a rigid translucent material, characterized in that the material recess (4) of the ski blade (2) is formed by cutouts of the strap(s) (7, 10) made of a high-strength opaque material, and that the at least one strap (6, 9) made of the rigid translucent material covers the material recess (4).

15 Claims, 2 Drawing Sheets

SKI

CROSS REFERENCE TO RELATED APPLICATIONS

This application is the US national phase of PCT application PCT/EP2008/005088, filed 24 Jun. 2008, published 31 Dec. 2008 as W02009/000496, and claiming the priority of Austrian patent application 1005/2007 itself filed 28 Jun. 2007, whose entire disclosures are herewith incorporated by reference.

The invention relates to a ski and in particular the invention relates to skis that have a recess in the ski tip.

It has been known for some time that the handling of a ski also depends on the vibration behavior of the ski tip. It was thereby recognized to be advantageous if the ski tip is made to be as light as possible, in order to save weight in this region. Thus, for example, the so-called hole ski was brought on the market, in which the ski tip had a throughgoing hole to save weight. In practice, this blade form did not become accepted. One problem was that with usual snow conditions the hole ski tended to let snow pass through the hole in the blade and not lift the ski over the loose snow, as would be desirable.

The object of the present invention is to reduce weight at the ski tip as well as in the entire ski. Vibration behavior is to be improved and the mass moment reduced. A quick recovery behavior of the ski tip is also sought. Overall, the ski is to have an increased smooth running characteristics and better track precision on an unsettled surface. Furthermore, an object is to make the reduction in weight clear to the buyer and yet also to provide the necessary stability of the ski.

The ski according to the present invention has the features of the claims.

The invention is described in more detail below based on an illustrated embodiment.

Figure 1:
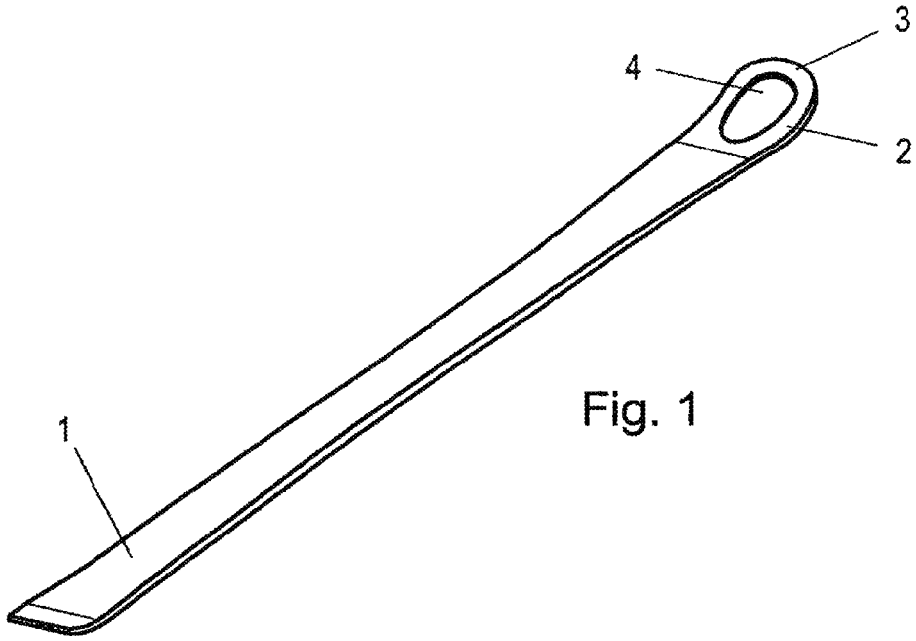
FIG. 1 is a perspective view from above of a ski.
Figure 2:
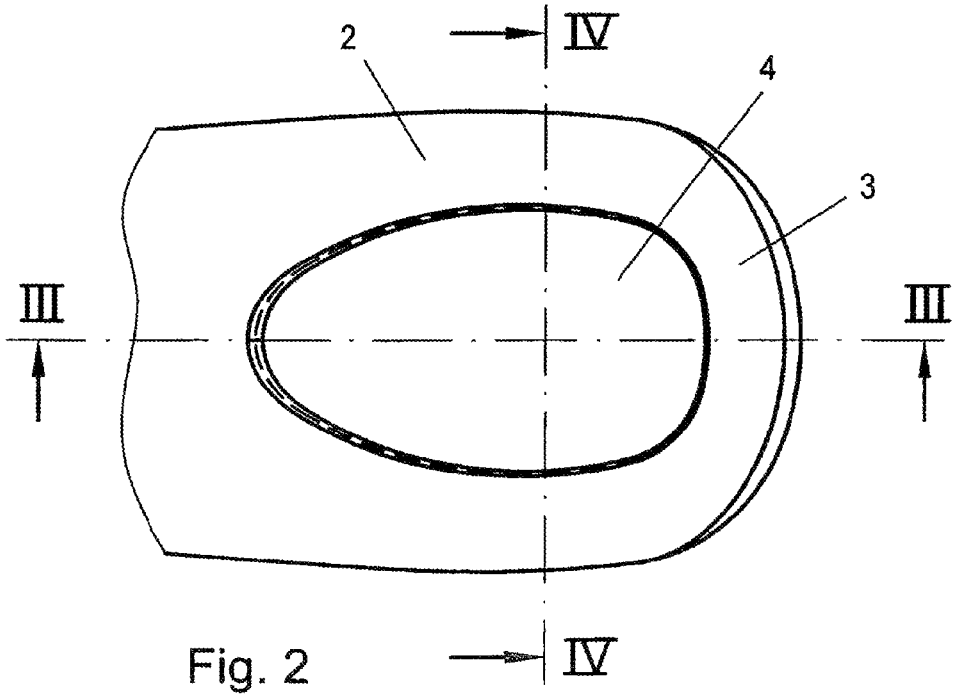
FIG. 2 is a the view of the ski tip.

FIG. 1 shows a ski 1 with a front tip 2 curved upward in the direction of travel and terminating at a ski front end 3. According to the invention, a recess 4 is formed at the ski tip. FIG. 2 shows the view of the ski tip to explain in more detail the sectional representations in FIGS. 3 and 4.

Figure 3:
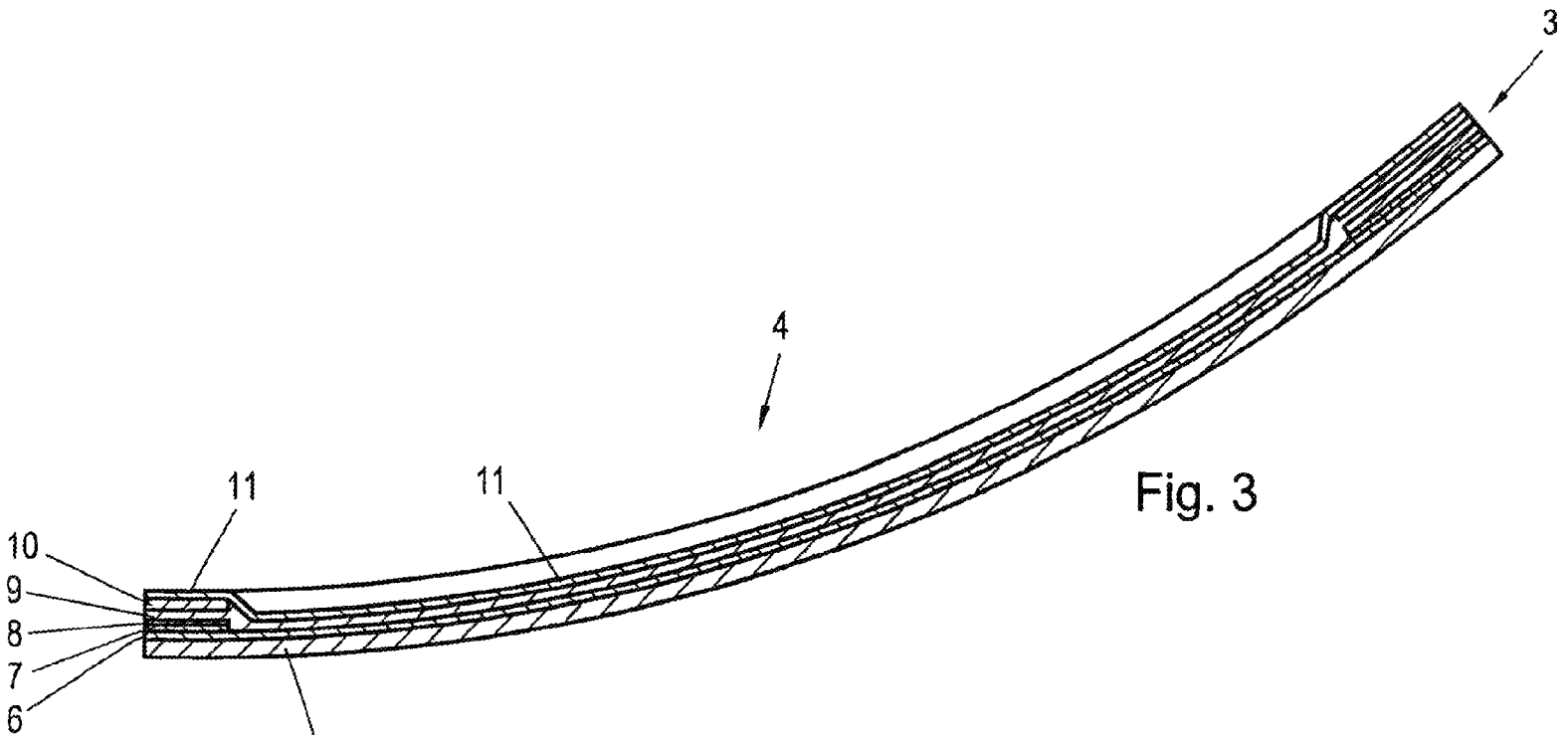
FIG. 3 is a longitudinal section through the ski tip according to line III-III and FIG. 4 is a cross section according to the line IV-IV of FIG. 2.
Figure 4:
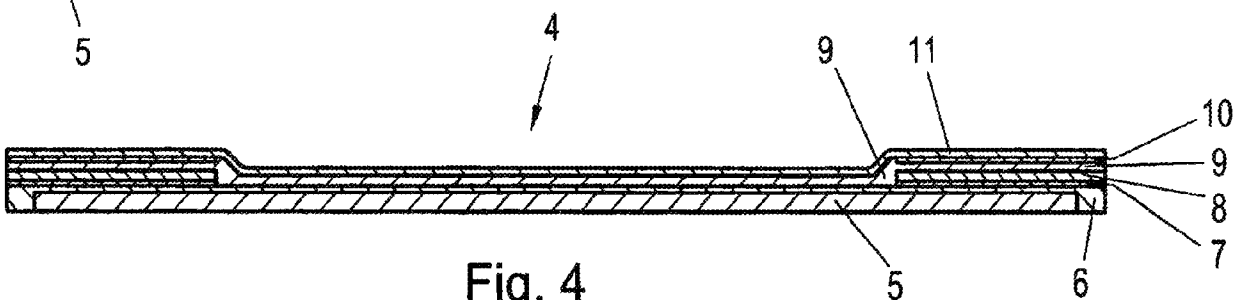

The layer structure of the ski over its entire length can be the same as in the prior art. It is thus known to provide the following layer structure from the top to the bottom:

Cover film with design
Upper layer of aluminum
Upper layer of glass-fiber reinforced plastic
Core of the ski or in the tip region the tip insert of elastic material
Lower layer of aluminum
Lower layer of glass-fiber reinforced plastic
Ski facing According to FIG. 3, the ski facing 5 is continuous and covers the recess 4. The lower layer 6 of glass-fiber reinforced plastic is directly above it. This lower layer also extends flatly over the recess 4 to the ski front end 3. Furthermore, the metal lower layer 7, which extends only to the edge of the recess 4, is not shown in the sectional views of FIGS. 3 and 4 except for portions extending around the recess. The same also applies to the tip insert of elastic material such as rubber identified at 8. According to the prior art, the tip insert is a continuation of the layer that forms the core in the ski.

The upper layer 9 of glass-fiber reinforced plastic extends over the entire surface of the ski and of the tip insert up to the ski front end and extends over and around the recess 4. This upper layer 9 is bonded to the glass-fiber reinforced lower layer 6 at the recess 4.

The metal upper layer 10 extends around the periphery above the upper layer 9 and is also formed with the recess, and above it the cover film 11 extends over the entire surface.

In a preferred manner, the ski coating 5, the lower layer 6 of glass-fiber reinforced plastic, the upper layer 9 of glass-fiber reinforced plastic and the cover film 11 are transparent or translucent. It is thus possible to create the optical effect of a hole in the ski, which is improved in terms of handling properties.

It goes without saying that the present invention can be modified in many ways without leaving the scope of the invention. The metal lower layer 7 and the metal upper layer 10 are preferably composed of aluminum alloy. However, all suitable high-strength materials can also be provided such as, e.g. other metal alloys, carbon and the like.

Instead of a single recess, the ski can also have several recesses of this type, e.g. by provision a core web along the center longitudinal line of the ski. Furthermore, it can be advantageous to fill in the region of the recess 4 that is thinned in cross section with a light transparent material in order to achieve smooth continuous surfaces. However, this would increase the weight of the ski tip.

List Of Reference Numbers

1 Ski
2 Ski tip
3 Ski front end
4 Recess
5 Ski coating
6 FG lower layer
7 Metal lower layer
8 Tip insert
9 FG upper layer
10 Metal upper layer
11 Cover film

The invention claimed is:

1. A ski comprising:

an elongated layer of opaque material formed at a tip of the ski with a recess forming a hole;

a layer of translucent material extending along at least one face of the layer of opaque material and across the recess;

a cover film on an upper surface of the layers and extending across the recess; and a coating on a lower surface of the layers and extending across the recess.

2. The ski defined in claim 1 wherein both the cover film and the coating are transparent and both layers are sandwiched between the film and coating.

3. The ski according to claim 1, wherein the ski has an upper layer and a lower layer of the opaque material, both the upper and lower layers are cut out to form the recess at the ski tip.

4. The ski according to claim 1, wherein the ski has an upper layer and a lower layer of the opaque material, both the upper and lower layers are cut out to form the recess at the ski tip, and the layer of translucent material is adjacent at least one of the layers of opaque material.

5. The ski according to claim 1, wherein the ski has an upper layer and a lower layer of opaque material, both the upper and lower layers are cut out to form the recess at the ski tip, and the layer of translucent material is between the upper and lower layers of opaque material.

6. The ski according to claim 1, wherein the layer of opaque material is made of high-strength opaque material.

7. The ski according to claim 6, wherein the high-strength opaque material is a metal.

8. The ski according to claim 6, wherein the layer of high-strength opaque material is aluminum.

9. The ski according to claim 6, wherein the layer of high-strength opaque material comprises carbon.

10. The ski according to claim 6, wherein the layer of translucent material is made of strong material.

11. The ski according to claim 10 wherein the strong material is fiber reinforced plastic.

12. The ski according to claim 10, wherein the layer of strong material is glass-fiber-reinforced plastic.

13. A ski with a ski tip, wherein the ski is formed of a layer of opaque material and a layer of translucent material, the layer of opaque material is cut out at the ski tip to form a recess, the layer of translucent material extends across the recess, the ski has an upper layer and a lower layer of opaque material, both the upper layer and the lower layer are cut out to form the recess at the ski tip, the layer of translucent material is between the upper layer and the lower layer of opaque material, the ski has a coating and a second layer of translucent material is between the coating and the first-mentioned layer of opaque material, and the layers of translucent material are on the top of each other at the recess.

14. The ski according to claim 13, wherein the ski coating is transparent, extends at least partially to a front end of the ski tip, and covers the recess from below.

15. The ski according to claim 13, wherein a cover film on top of the ski is transparent and at the recess engages the first layer of translucent material.

* * * * *